United States Patent [19]

Herder

[11] Patent Number: 4,561,107

[45] Date of Patent: Dec. 24, 1985

[54] WEB OF PLASTIC BAGS

[75] Inventor: Kornelis Herder, Goor, Netherlands

[73] Assignee: Wavin B.V., Zwolle, Netherlands

[21] Appl. No.: 381,228

[22] Filed: May 24, 1982

Related U.S. Application Data

[63] Continuation of Ser. No. 148,016, May 8, 1980, abandoned.

[30] Foreign Application Priority Data

May 11, 1979 [NL] Netherlands ..... 7903733

[51] Int. Cl.[4] ..... B65D 27/10

[52] U.S. Cl. ..... 383/37; 383/122

[58] Field of Search ..... 229/69; 383/37, 122; 493/197–193, 226, 926, 230, 229, 213

[56] References Cited

U.S. PATENT DOCUMENTS

| | | | |
|---|---|---|---|
| 3,277,798 | 10/1966 | Krauss | 493/232 |
| 3,395,622 | 8/1968 | Kugler | 493/196 |
| 3,548,722 | 12/1970 | Jones et al. | 493/196 |
| 4,055,109 | 10/1977 | Kan | 493/232 X |

*Primary Examiner*—James F. Coan

*Attorney, Agent, or Firm*—Wilkinson, Mawhinney & Theibault

[57] ABSTRACT

A web of interconnected plastic bags produced by providing a tubular foil of plastic material with gusset folds with bottom fold part seals at both sides of the tubular foil. Each fold part seal connects a gusset fold part with an opposite part of the outer foil layers. Immediately after having moved the tubular foil over a predetermined distance the tubular foil is provided with a first transverse bottom seal by heatsealing opposite first fold part seals and outer foil layers to each other.

6 Claims, 6 Drawing Figures

WEB OF PLASTIC BAGS

This application is a continuation of application Ser. No. 148,016, filed 5/8/80, now abandoned.

BACKGROUND OF THE INVENTION

1. Field of the Invention

The present invention relates to a method of producing a web of plurality of interconnected plastic bags with longitudinal gusset folds, at least comprising a central and two outer longitudinal gusset fold edges which bound a first and a second gusset fold part, by providing a continuously supplied tubular plastic foil by heatsealing with a first transverse bottom seal which extends across the entire width of the tubular foil and moving the tubular foil over a predetermined distance to another sealing position.

2. Description of the Prior Art

A method of this type has been used in the prior art. In the prior art methods the first transverse bottom seal is produced by heatsealing the various different foil layers across the entire width of the bag after having applied first and second fold part seals slopingly extending with respect to one another, preferably under an angle of 45°, at both ends of the bag.

The first fold part seals contact the first transverse bottom seal so that a filled bag can be given a block shape at the bottom side. The second fold part seals likewise form, together with a final heatseal to be applied, a block bottom, thus causing a filled bag to have a block shape at either side.

The difficulty with the said prior art method is, that it is inappropriate, as the quality of the first transverse bottom seal leaves much to be desired, which is inherent with the fact that in a heatsealing process two foil layers have to be heatsealed to each other in the central part of a tubular foil web, whilst four foil layers have to be heat-sealed to each other in gusset fold parts. Especially the transition from the two-layer-seal toward the four-layer-seal will involve problems and particulary a weakening of the foil material.

SUMMARY OF THE INVENTION

In view of the foregoing factors and conditions of the prior art it is a primary object of the present invention to provide a method overcoming these drawbacks.

According to the present invention this aim is attained in that (a) a tubular foil is provided at both sides with at least bottom fold part seals, each bottom fold part seal obtained by heatsealing a gusset fold part to the opposite outer foil layer, said bottom fold part seals extending from an outer gusset fold edge to the nearest central gusset fold edge;

(b) subsequently the tubular foil as obtained under step a) is moved over a predetermined distance and immediately after having reached another sealing position a transverse bottom seal is formed by simultaneously heatsealing the opposite foil layers, extending between the central gusset fold edges and opposite bottom fold part seals to each other.

It has appeared that in this manner a first transverse bottom seal is obtained of a much better quality than before, as according to the present invention only two layers need be interconnected across the entire width of the tubular foil layer. Said layers consist of superimposed central tubular foil layers of the tubular foil and the bottom fold part seals which are now integrated while forming the first transverse bottom seal.

As forming the first transverse bottom seal is now less timeconsuming than in prior art methods, the production speed can be increased. Actually, when heatsealing the first transverse bottom seal in the second step, heat is employed which was added to the material in the first step on forming the bottom fold part seals, so that less heat need be supplied during the second step, thus allowing an economy on the time of heatsealing of about 20%, or in other words, energy is saved.

Moreover, the reduced sealing time allows a longer cooling period before coiling the web. In this respect it should be noted that during coiling the tubular foil is subjected to a stretching load which might tear an insufficiently cooled heatseal. This lastmentioned problem is now overcome by the present invention.

A preferred embodiment of the present invention comprises the following steps:

a. At both sides of the tubular foil, two first fold part seals are formed, whereby each first fold part seal always connects an outer foil layer with an opposite gusset fold part.
b. At a predetermined distance from said first fold part seal always at least two second fold part seals are formed at both sides of the tubular foil, which second fold part seals connect an outer foil layer part with the opposite gusset fold part.
c. First and second fold part seals are formed between the central and outer longitudinal fold part seals, in the direction of the nearest bag end.
d. The first fold part seals or their extensions are formed to intersect the first transverse bottom seal, substantially in the area near the intersection of a first transverse bottom seal with the central longitudinal gusset fold edges.
e. Forming bottom fold part seals, and
f. Forming said first transverse seal after said first and second fold part seals have passed the sealing zone for forming the first transverse bottom seal.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF A PREFERRED EMBODIMENT

Figure 1:
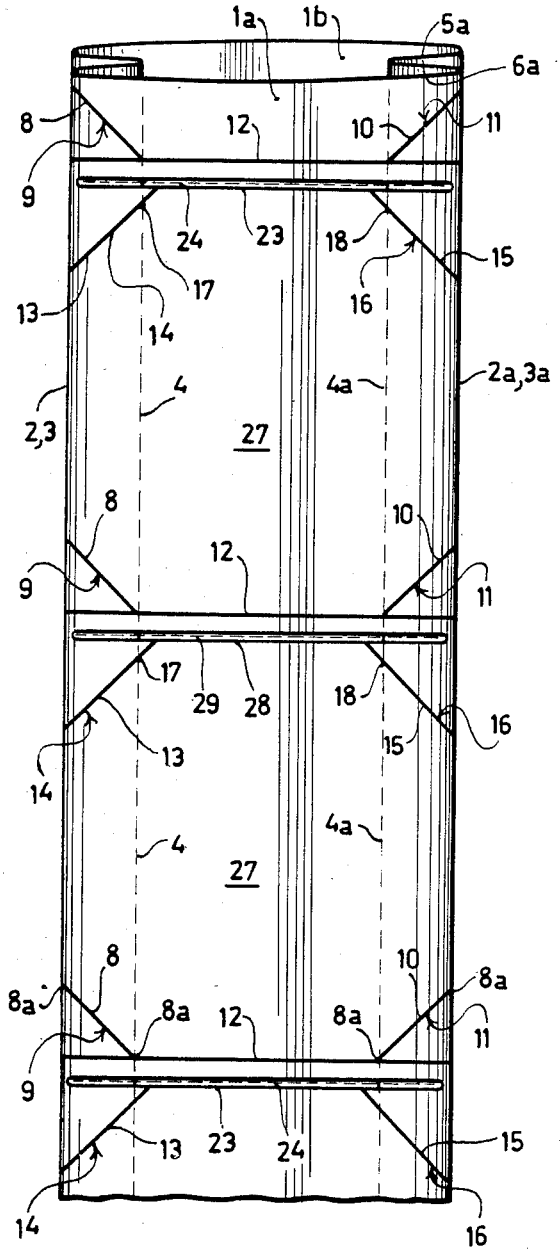
FIG. 1 is a first web of plastic bags comprising a plurality of interconnected plastic bags according to the present invention.

Initially referring to FIG. 1, a web of bags in accordance with the present invention comprises consecutive plastic bags 27 with longitudinal gusset folds, each bag 27 including two outer longitudinal gusset fold edges 2, 3, 2*a*, 3*a* respectively and a central longitudinal gusset fold edge 4, 4*a* respectively.

One end of the bag is provided with a first transverse bottom seal 12, so that the superimposed web foil layers 1*a*, 1*b*, are at least interconnected in the region between the central longitudinal gusset fold edges 4, 4*a*.

As can be seen, the first transverse bottom seal 12 also extends upon the outer longitudinal gusset fold edges 2, 3, 2*a*, 3*a*, whereby in first instance the superimposed foil layers 1*a* and 1*b* are interconnected with each other, whilst the foil layers 1*a* and 1*b* and first gusset fold part 5 and second gusset fold part 6 are all inter connected.

In order to give the completed bag a blockbottom-shape, a first fold part seal 8 extends from intersection 8*a* of the transverse bottom seal 12 with the central longitudinal gusset fold edges 4, 4*a* to the outermost longitudinal gusset fold edges 2, 3 and 2*a*, 3*a*. In a flat condition of the bag a second fold part seal 9 is situated below said seal, said second fold part seal 9 extending in a manner corresponding with that of the fold part seal 8.

At the other side of the bag also similar first fold part seals 10, 11 extend between the intersection 8*a*' of the first transverse bottom seal 12 with the central longitudinal gusset fold edge 4*a* and a point upon one of the outer longitudinal gusset fold edges 2*a*, 3*a*. The first fold part seals 8, 9, 10 and 11 extend advantageously under an angle of 45° with respect to the outer longitudinal gusset fold edges.

At the other end the bag is provided with second fold part seals 13, 14 which extend from the outer longitudinal gusset fold edges 2 and 3 to upon the central longitudinal gusset fold edge 4, whilst fold part seals 15 and 16 extend from the longitudinal gusset fold edges 2*a* and 3*a* to upon the central longitudinal gusset fold edge 4*a*.

The second fold part seals 13, 14, 15, 16 appropriately extend under an angle of 45° with respect to the extension of the line interconnecting the end points 17 and 18 of the aforementioned four second fold part seals 13, 14, 15 and 16.

Figure 2:
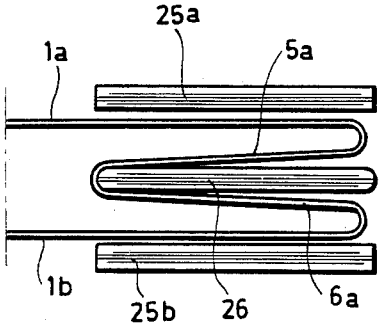
FIG. 2 shows the members for forming first and second fold part seals.
Figure 3:
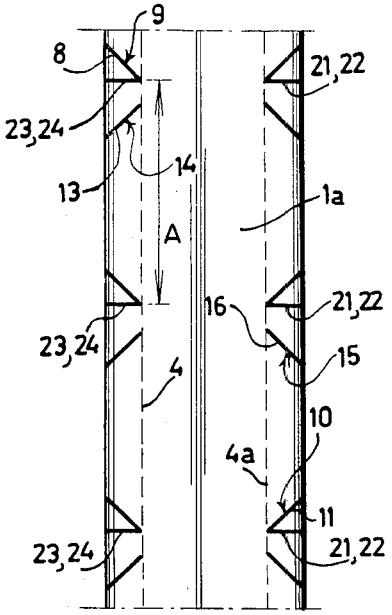
FIG. 3 is a tubular foil comprising first, second and bottom fold part seals as obtained in this manner.

Referring now to FIG. 3, the first step is shown of forming a web of plastic bags in accordance with the present invention, To that end the bag is provided with first and second fold part seals 8, 9, 10, 11 and 13, 14, 15, and 16. In order to prevent a heatsealing of for instance a gusset fold part 5*a* together with a second gusset fold part 6*a*, a separating means 26, for instance a Pertinax sheet, is disposed between said gusset fold parts 5 and 6 and 5*a* and 6*a*. The heatsealing members 25*a*, 25*b* will then form the desired fold part seals. Said seals may be produced in about 1.5 sec. (see FIG. 2).

Simultaneously with forming the first fold part seals, bottom fold part seals 23, 24 and 21, 22 are applied at either side of the tubular foil, which bottom fold part seals 21, 22 and 23, 24 intersect the first fold part seals 10, 11 and 8, 9 at the inner longitudinal gusset fold edges 4*a*, 4.

As the respective superimposed fold part seals are not yet sealed to each other, the separting means 26 need not be removed during transport of the tubular foil over a predetermined distance A to another sealing zone or another position, which strongly facilitates the processing of said tubular foil.

After having displaced the tubular foil over a distance A from a first transverse bottom seal, a new first transverse bottom seal 12 is formed by heatsealing to each other the foil web parts 1*a* and 1*b* between the intersections of the first and bottom fold part seals, while simultaneously the still hot superimposed bottom fold part seals 23, 24, 21, 22 are likewise heatsealed to each other.

In order to form the first transverse bottom seal 12, a support 19 is used, and a heatsealing bar 20. It will be obvious, however, that said support 19 may also be a heatable support.

The upper foil layer of the tubular foil 1*a* between consecutive bags is cut through thereby forming a cut 28, whilst the other side of the bag is perforated or superficially incised by means of an incision 29.

Due to the fact that first the bottom gusset fold part seals 21, 22, 23, 24 are formed, a considerable economy of time is obtained for forming the first transverse bottom seal, while furthermore an economy of heat may be obtained. The heat being used for forming the bottom fold part seals 21, 22, 23, 24 extending perpendicularly to the longitudinal central gusset fold edge 4, 4*a*, is, actually, partially retained in the plastic material until the heatsealing bar 20 is operated for forming the first transverse bottom seal 12. If, for example, the four layers in the gusset fold parts would be simultaneously heatsealed to each other, the above economies could not be obtained. Thus, first applying the bottom fold part seals offers a considerable economy, as the production speed can be increased by about 20%.

Figure 4:
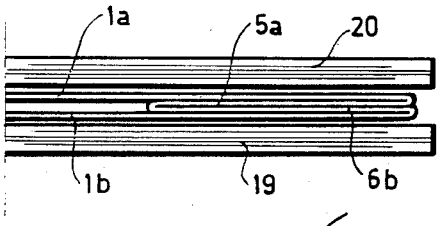
FIG. 4 shows how first transverse bottom seals are formed with the present apparatus.
Figure 5:
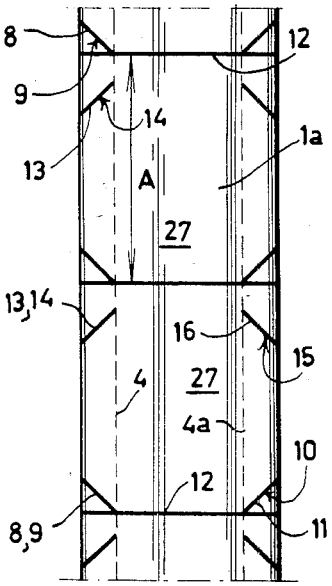
FIG. 5 is the web during the formation of the first transverse bottom seals.

Referring now to FIG. 4, the manner in which the first transverse bottom seals are formed is clearly shown, whilst FIG. 5 is a web of plastic bags, comprising three transverse bottom seals.

Figure 6:
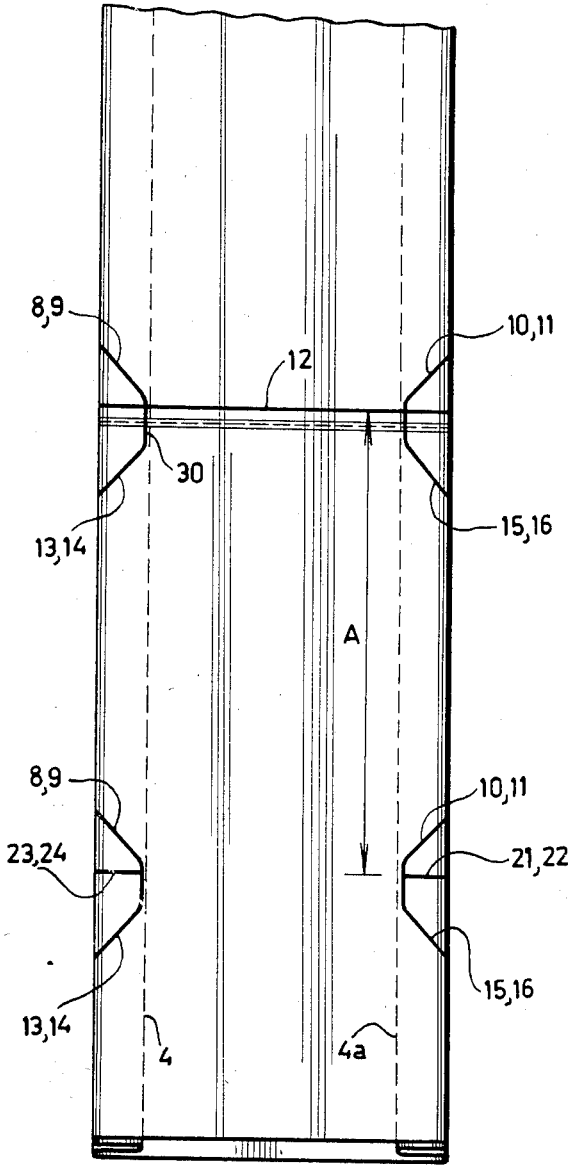
FIG. 6 is a variant of the web during its formation.

Finally referring to FIG. 6, being another embodiment of the seals to be applied, it can be clearly seen that the first fold part seals 9, 10 and 11 and the second fold part seals 13, 14, 15, 16 are interconnected by means of an additional seal 30 which runs parallel to the longitudinal edges 4, 4*a* of the tubular foil. A seal 30 of this type may simplify the filling of a bag.

What is claimed is:

1. A web of a plurality of interconnected valve free plastic bags (27) with gusset folds formed from a tubular foil, at least comprising a central (4, 4*a*) and two outer longitudinal gusset fold edges (2, 3, 2*a*, 3*a*) which bound a first and a second gusset fold part, each bag (27) of said web being open at one end opposite a transverse bottom seal (12) and further comprising:

(a) two first fold part seals (8, 9; 10, 11) at both sides of the web foil, which first fold part seals always connect an outer foil layer (1*a*, 1*b*) with an opposite gusset fold part (6*a*, 5*a*; 6, 5) said first fold part seals extending between the central (4, 4*a*) and outer longitudinal fold edges (2, 3; 2*a*, 3*a*) in the region of said transverse bottom seal (12) and diverging from said bottom seal (12) to the outer fold edges (2, 2*a*; 3, 3*a*), (b) second fold part seals (13, 14; 15, 16) at both sides of the web foil which second foil part seals always connect an outer foil layer (1*a*, 1*b*) with an opposite gusset fold part (6*a*, 5*a*; 6, 5) said second fold part seals extending between the central (4, 4*a*) and outer longitudinal fold edges (2, 3; 2*a*, 3*a*) at the end of the bag remote from the transverse seal of this bag, said second fold part seals converging from the outer longitudinal fold edges (2, 3; 2*a*, 3*a*) to the transverse seal (12) of a subsequent bag (27) characterized in that at both sides of a bag an additional seal (30) extends substantially parallel to the fold edges and in the region between inner and outer fold edges, said additional seals (30) being connected with the second fold part seals (13, 14; 15, 16) and extending from said second fold part seals towards the transverse bottom seal (12) of a subsequent bag (27).

2. A web according to claim 1, characterized in that the additional seals (30) extend near the inner fold edges (4,4*a*).

3. A web according to claim 1, characterized in that the additional seals extend to a filling opening (28) of said bag.

4. A web according to claim 3, characterized in that the additional seals (30) connect first and second fold part seals.

5. A web according to claim 4, characterized in that the additional seals (30) extend at both sides of a transverse bottom seal (12).

6. A web of a plurality of interconnected valve free plastic bags (27) as claimed in claim 1 further comprising wall weakenings (29) across said web for facilitating separation of an at one end open bag from said web.

* * * * *